United States Patent [19]

Wolf

[11] Patent Number: 4,617,497

[45] Date of Patent: Oct. 14, 1986

[54] SPINNING OR TWISTING MACHINE CONTROL SYSTEM

[75] Inventor: Horst Wolf, Albershausen, Fed. Rep. of Germany

[73] Assignee: Zinser Textilmaschinen GmbH, Ebersbach/Fils, Fed. Rep. of Germany

[21] Appl. No.: 718,163

[22] Filed: Apr. 1, 1985

[30] Foreign Application Priority Data

Mar. 31, 1984 [DE] Fed. Rep. of Germany ..... 3412060

[51] Int. Cl.[4] ..... H02P 5/46

[52] U.S. Cl. ..... 318/78; 318/41; 318/77; 318/101

[58] Field of Search ..... 307/43, 44, 46, 48, 307/64, 66; 318/41, 46, 47, 51, 77, 78, 85, 101, 103, 105, 706, 715, 721, 722, 723, 106, 107, 108, 109, 440, 441, 442

[56] References Cited

U.S. PATENT DOCUMENTS

| | | | |
|---|---|---|---|
| 3,515,894 | 6/1970 | Swing et al. | 307/64 |
| 3,668,418 | 6/1972 | Godard | 307/66 |
| 4,096,394 | 6/1978 | Ullmann et al. | 307/48 X |
| 4,471,233 | 9/1984 | Roberts | 307/66 |
| 4,475,047 | 10/1984 | Ebert, Jr. | 307/66 |
| 4,518,899 | 5/1985 | Wolf | 318/51 X |
| 4,528,459 | 7/1985 | Wiegel | 307/66 |

FOREIGN PATENT DOCUMENTS

| | | | |
|---|---|---|---|
| 2137033 | 9/1984 | United Kingdom | 307/66 |

*Primary Examiner*—William M. Shoop, Jr.
*Assistant Examiner*—Bentsu Ro
*Attorney, Agent, or Firm*—Karl F. Ross; Herbert Dubno

[57] ABSTRACT

An emergency battery power supply for a ring-spinning or ring-twisting frame can be brought into operation by an automatic circuit to bridge brief power failures and effect programmed shutdown of the motors upon longer power failures, with the speed ratios between the motors being maintained substantially to standstill to avoid yarn breakage during shutdown.

16 Claims, 2 Drawing Figures

SPINNING OR TWISTING MACHINE CONTROL SYSTEM

FIELD OF THE INVENTION

My present invention relates to a spinning or twisting machine control system having at least two separate motors driving respective loads and operated with high voltage and high power inputs from a means or line supply.

BACKGROUND OF THE INVENTION

It is known to provide control systems in the textile arts to control spinning or twisting machines or frames which can have two separately supplied electric motors driving respective loads and fed with mains or line voltage—i.e. a relatively high voltage by comparison with that which may be used for control purposes—and high current.

While the invention will be described and has been found to be particularly useful for ring-spinning and ring-twisting frames, the principles are equally applicable to other spinning and twisting machines and textile machinery such as drafting frames, flyer, OE and doubler spinners and twisters and the like in which a plurality of electric motors are used and wherein one or more must be brought from the operating speed to standstill.

With ring spinning machines, it has already been recognized that a reduction in speed from the normal operating speed to standstill should not be effected simply by shutting off the motor involved, but rather that a control circuit for shutdown purposes should be used to initially reduce the speed to a predetermined lower level, e.g. such that the spindles are driven at about only 8000 rpm, a considerable reduction from the normal operating speed. After the reduced but still substantial speed is reached, the circuit simultaneously cuts off all of the relevant motors and, at the same time, actuates respective brakes so arrayed with respect to even the slowest system to reach standstill that substantially all of the motors and the respective loads reach standstill simultaneously.

This ensures that the spindles will not reach standstill before the drafting rollers or vice versa so that yarn breakage is minimized.

Conventional automatic shutdown systems of this type operate, however, only as long as the system is supplied by the mains or line current. They completely fail upon sudden power failures in the line or mains. In such cases, the motors are deenergized in fractions of a second and the apparatus is brought practically instantaneously to standstill in a totally uncontrolled manner resulting in numerous yarn breakages and other damage to the yarn, rovings and filaments.

OBJECTS OF THE INVENTION

It is, therefore, the principal object of the present invention to provide, in a textile machine and especially a spinning or twisting machine, a control whereby sudden power (electrical) failures nevertheless allow a controlled passage of the machine to standstill.

Another object is to provide a spinning or twisting machine whereby the aforementioned disadvantages are obviated.

Yet another object of my invention is to provide an improved control system for spinning and twisting machines which can minimize thread breakage and other detriment to yarns, threads and rovings, even in the case of sudden shutdown due to mains or line failures as well as other system failures.

SUMMARY OF THE INVENTION

These objects and others which will become apparent hereinafter, are attained according to the invention with a control system for a spinning or twisting machine which comprises at least one emergency service or standby battery and an emergency current supply system connected to and supplied by the battery, which system in turn supplies the requisite current for the circuit components bringing the motors to controlled standstill in the manner previously described and, via these components, also at least one of the drive motors. The system of the invention has been found to be extremely reliable and cost effective. It is simple to build and install. In spite of sudden failure of the line current supply to the machine, it allows the controlled shutdown of the machine so that during the shutdown to standstill there is no significant breakage of yarns or rovings, nor are significant stresses or tensions applied so that the bobbin or package windings remain uniform during shutdown and bulge formations do not occur upon the spools.

The emergency current-supply unit can automatically respond to a power failure and supply all of the power consuming components of the machine and its controls required for shutdown. These components include the drive motors, brakes, control units and the like. Since the line or mains current is usually 50 or 60 Hz alternating current and especially three-phase alternating current, the current supply circuit can include a direct current/alternating current converter producing a corresponding alternating current.

The control circuit can include a sensor for the continuity of the line current which triggers the emergency circuit into operation upon detection of a power failure.

Thus the circuit can include an electromagnetic relay (sensor) energized by the lines current and which, upon deenergization, switches all or part of the emergency supply circuit into operation. The latter circuit components remain inactive as long as the relay is supplied with current from the line or mains. Upon a power failure, the relay immediately switches the emergency system into operation to replace the failed line current with battery power. At least one emergency battery can continuously be connected to a load fed thereby.

The electric motors which drive operating loads in the machine of the invention are generally alternating current motors, especially three-phase motors. They can be either asynchronous motors or synchronous motors or both. One or more of the motors can, however, be direct current motors. When the motors are AC motors, the emergency supply circuit includes the DC/AC converter as described. The converter can have a constant output frequency or a continuously or stepwise adjustable output frequency.

The system of the invention can operate to bring the machine to standstill in the event of any and each power failure. This, however, can result in a comparatively long down time of the machine considering the complexity of startup.

Frequently a power failure lasts for a comparatively brief period, e.g. from a fraction of a second to several seconds or minutes. In order to avoid a total shutdown, I provide a timer or time delay circuit or unit which establishes a predetermined time period such that, in the event of a power failure shorter than this period, the original speed is maintained by the battery or only a minimum reduction is undertaken. If the power failure continues after the lapse of the predetermined period, the total controlled shutdown is triggered. If the power failure is less than the predetermined period, the lines current is restored and the emergency system is inactivated. In the latter case, of course, in spite of power failures there may be no interruption of machine operation.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
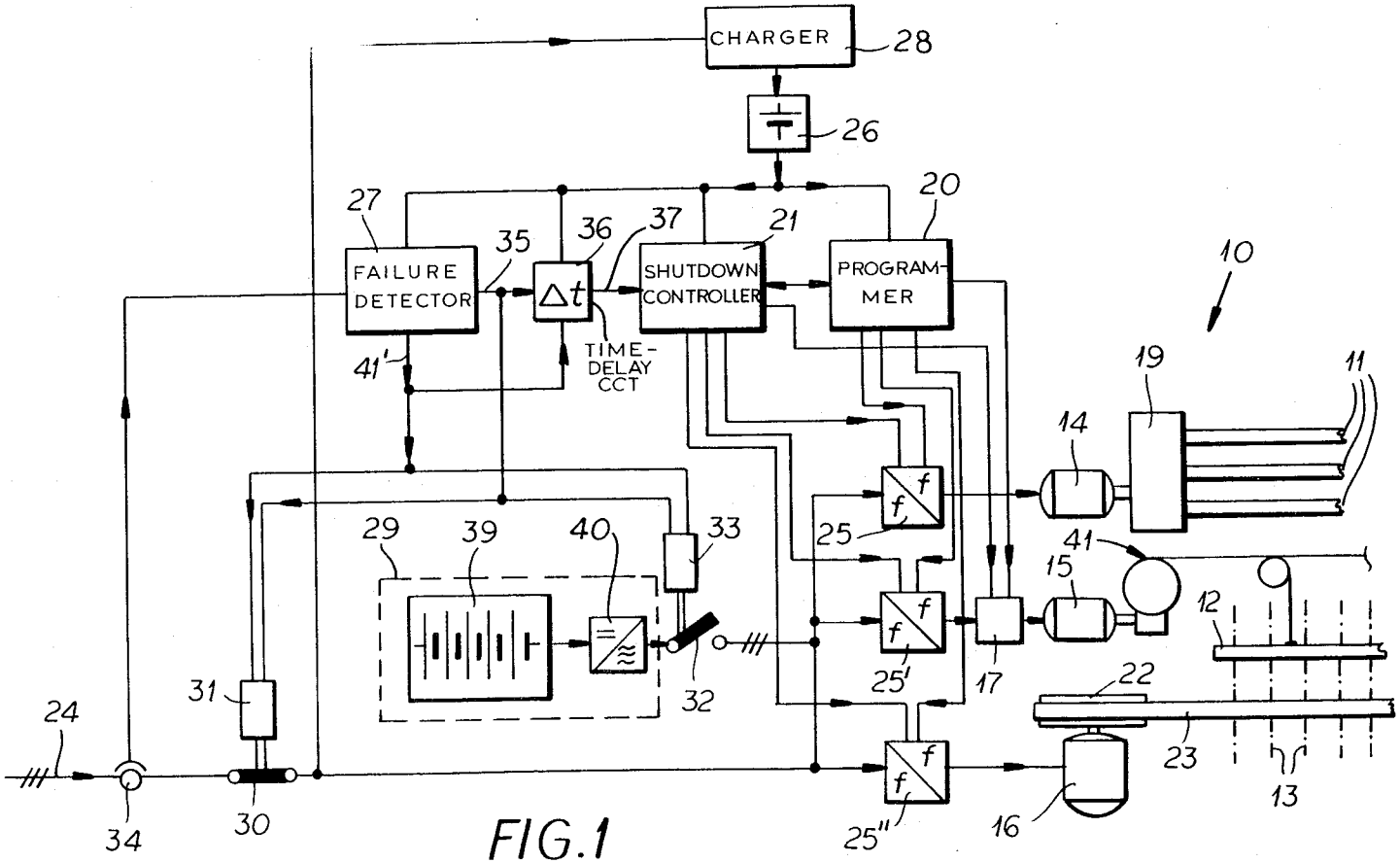
FIG. 1 is a block diagram and partial circuit diagram of a control system in accordance with the present invention for the controlled shutdown of a spinning or twisting machine in the event of a power failure.

In FIG. 1, I have shown in highly diagrammatic form, a ring spinning machine 10 (which, of course, can also be a twisting machine) which can comprise a drafting unit, the lower rollers 11 of which have been illustrated and are seen to be driven via the transmission 19 by an electric motor 14. The drafting unit, of course, applies tension and stretches the rovings.

In addition, the ring spinning machine comprises a plurality of banks 12 of ring spinning spindles which have been represented in highly diagrammatic form at 13. The spindles of course pass through the banks of rings. The spindles can be driven by a belt 23 in any conventional manner, the belt 23 being the belt which usually extends along the full length of the spinning frame. The belt 23 is driven by a wheel or sheave 22 which is driven by the electric motor 16. The ring bank 12 is given an upward and downward reciprocating motion by a second electric motor 15 whose output shaft works into a worm drive for a wheel 41 connected by a cable to the ring bank drawing the latter upwardly or permitting the latter to descend by gravity when the wheel is rotated reversibly.

The motor 15 is a programmed motor which is reversible by a reversing circuit shown at 17 operated by the program controller or programmer 20 or a switching unit or shut down controller 21 so that the ring bank is reversibly driven.

All of the spindles 13 are driven by the third motor 16 via the belt 23 which tangentially engages the whorls of these spindles and passes, as noted, around the sheave 22.

While the three motors illustrated may operate the entire spinning frame, it is generally advantageous to provide three motors equivalent to the motors driving the ring bank 12, the spindles 13 and the drafting rollers 11, i.e. the motors 14–16, so that a separate set of motors is provided on each side of the spinning frame. In that case, the control system illustrated in FIG. 1 can operate six motors instead of the three shown.

The three electric motors 14, 15, 16 (or the six corresponding motors when two sets of motors are provided) can be asynchronous motors and/or synchronous motors. Each of these three motors 14, 15, 16 is connected to the three-phase high-current line or mains 24 via a respective frequency converter 25, 25′, 25″ so that the output frequency of these converters can be controlled by the programmer 20. This allows speed control of the motors.

The frequency can range, for example, from 0 Hz or some low minimal value to a predetermined maximum frequency and the adjustment can be stepless or in small increments.

The stepping or increase of this frequency during the startup of the machine 10 from standstill and, if desired, the variation in this frequency during normal operation is controlled by the programmer 20. The latter may make use of a microprocessor which can be preprogrammed for this purpose or a microcomputer which can be provided with a particular startup speed sequence control.

When it is desired to effect a spool-core or sleeve change on the machine, the shutdown controller 21 can be actuated by hand or automatically to bring the machine 10 to standstill in a controlled manner. As can be seen from FIG. 1, the shutdown controller 21 is connected to the frequency converters 25, 25′ and 25″ as well so that during shutdown the speed ratios of the motors is meticulously maintained so that there will be a minimum of yarn breakage and/or undesired defects in the spinning bobbins or spools as a result of the gradual shutdown of the machine. The cops, therefore, remain free from defective turns in spite of the shutdown operation.

The shutdown controller 21 can be effective in this manner by, as shutdown is instituted, controlling the output frequencies of the three frequency converters so that during the shutdown phase all the way to standstill the ratio of the frequencies outputted by the converters remains the same. The frequencies can be reduced continuously while maintaining their ratios or in small steps, i.e. the small increments mentioned previously, from operating frequency to zero or to some low minimal frequency from which standstill can be effected without further detriment. The minimal frequency is selected and the rate at which the speed is reduced for each of the motors is selected so that no detriment resulting from differences in the moments of inertia of the various operating systems will occur.

As a practical matter, the key to the shutdown rate is the spindles 13 and the shutdown rates of both the ring bank 12 and the lower rollers 11 of the drafting unit which are coordinated thereto so that the desired ratio is maintained to preclude both breakage of the yarn and an absence of defective turns on the cops.

In the event of an unforeseeable and sudden power failure of the line or mains 24, in the absence of the circuitry of the invention, the shutdown controller 21, because it is no longer supplied with current, and the motors 14–16 because they would be no longer supplied with current would be suddenly and uncontrolledly brought to standstill.

As a consequence, the ring bank 12 and the drafting unit very well might be brought to standstill well before the spindles 13. As a consequence, overwinding of the spindle may cause yarn breakage. In any event, because the ring bank 12 would be brought to standstill before the spindle 13, a bulge would tend to form in the cop on the bobbin.

In the case that the drafting unit comes to standstill as the last of the units, the roving supplied thereby would not be picked up by the spindles 13 which have previously been brought to standstill and as a consequence, yarn breakage may occur here as well. That is why the machine is equipped with an emergency control system in accordance with the present invention.

The shutdown controller 21 and the programmer 20 are, upon sudden power failure of the line or mains 24, supplied with electric current by a first emergency or standby battery 26 which forms a first emergency current source supplying direct current to these control elements. It should be noted that elements 21 and 20 generally form part of a computer as previously described which utilizes direct current for the data and processing signals and thus no converter is required for this purpose.

According to the invention, a current-failure sensor or detector 27 is provided and at the instant that a current failure occurs is immediately and instantaneously enabled.

In an embodiment not illustrated in FIG. 1 but representing only a minor modification thereof, this current detector 27 can trigger the standby battery 26 to immediately begin feeding the control elements 20 and 21 and cut these elements off from the line or mains 24 from which they were formerly supplied. Alternatively and in the best mode embodiment which has actually been illustrated in FIG. 1, the emergency battery 26 may be maintained at constant charge by a battery charger 28 represented only diagrammatically and connected to the line or mains 24 so that the battery 26 is always at full charge and the control elements 20, 21 (as well as the detector 27) are constantly supplied by this battery 26 which continues to supply the control current even after the battery charger 28 is no longer effective by reason of a line failure.

Consequently, at the beginning of a power failure of the type described, the battery 26 is always at full charge and can supply the usual control current without interruption to the shutdown controller 21 and the program controller 20.

A second emergency supply source, namely, the battery 39 is provided as well. The battery 39 here forms part of an emergency alternating current supply represented at 29 which can deliver sufficient current for emergency operation of the three electric motors 14, 15, 16. The battery 39 is followed by a DC/AC converter 40 which is connected to the motors 14–16 via the respective frequency converters 25, 25′, 25″ and a switch 32 forming part of a relay 33. The power source 29 supplies three-phase current to the converters 25, 25′, 25″ operating the electric motors as indicated.

If necessary for the selection of the voltage necessary to operate the motors, the converter 40 can include a transformer not shown. Consequently, the output voltage of the emergency source 29 can correspond exactly to the voltage supplied by the line or mains 24 and to the frequency thereof, generally 50 Hz or 60 Hz.

The two emergency current sources 26 and 29 constitute the emergency power supply unit for the machine 10.

The machine 10 is supplied with electric current from the line or mains 24 through a mains switch 30 forming part of the motor control switching of a relay 31. When the relay 31 is energized, switch 30 opens and the relay 33 in parallel with the relay 31 is deenergized to allow the switch 32 to instantaneously and automatically close.

In the embodiment illustrated, the relays 31 and 33 are operated by the current failure detector 27 but it will be understood that the relay 31 can be operated independently of the relay 33 by the shutdown controller 21 when the machine 10 is brought to standstill or its speed has been reduced sufficiently by the shutdown controller 21 that the machine is operated at such a low speed that immediate open circuiting of the switch 30 is possible without detriment.

The arrangement of the relays 31 and 33 shown, ensures that the motors 14–16 will be continued to be supplied with current without interruption in spite of the interruption of the line or mains supply.

The detector 27 can be triggered by a voltage failure sensor 34 located upstream in the line or mains circuit of the switch 30 so that the absence of a voltage in the line or mains can be readily detected.

Since the line or mains 24 is assumed to be continuously under voltage to supply current in ordinary practice, the failure of a voltage at the sensor 34 will represent a power failure. Any power failure can be detected, therefore, whether by reason of a lightening strike on above-ground power lines or some other interruption.

As soon as the voltage failure is sensed, a signal is provided to the detector 27 which is also supplied with emergency power from the battery 26 to generate an output signal at the output line 35, e.g. a single pulse.

This single pulse is applied to the input of a time delay circuit 36 which can constitute an electronic timer commencing a timing operation upon receipt of this signal. Upon the lapse of the predetermined delay $\Delta t$, an output signal is generated at the output line 37 which can reset the timer and also signal the shutdown controller 21 to begin an automatic shutdown of the motors 14–16 in accordance with the preprogrammed relationship while maintaining the desired ratios of the operating speeds of these motors. The electronic timer 36 is also supplied by the battery 26.

The timer 36, therefore, prevents the controlled shutdown in the event of power failures shorter than the $\Delta t$ period preset therein.

The restoration of power, sensed by the detector 27 and its sensor 34 within this period $\Delta t$ will simply deenergize relay 31 and energize relay 33 to close switch 30 and open switch 32 and restore the mains power supply to the motors.

It has been found that in some cases power failures as brief as say 30 to 100 milliseconds will not be detrimental to the operation of the apparatus, i.e. will not sufficiently reduce the speed of the loads 11, 13, 41, or the motors driving them for example. In that case, a further time delay circuit element can be provided in circuit with the relay 33 or as part of this relay, i.e. the relay 33 may be a time delay relay, so that the emergency power supply is not applied to the motors until the lapse of this brief interval over which there is no material speed reduction.

As indicated, the output frequency of the voltage converter 40 can be equal to the frequency of the current supply network 24, i.e. normally 50 Hz or 60 Hz.

The emergency service battery 39 of the second emergency current source 29 has a capacity at least sufficient to supply the electric motors 14, 15 and 16 with electrical energy during the controlled shutdown of the machine to standstill. This battery 39 also can be charged substantially continuously by the line or network current supply 24 so that it is always at full charge in preparation for emergency operation. Alternatively, the battery can be charged from time to time utilizing a conventional charger. A sufficient number of lead acid cells may be provided to form the battery 39.

When power is restored within the time interval Δt, the sensor 27 also resets the timer 36. During the power failure interval which can range from a fraction of a second to several seconds or even several minutes, the power for operating the motors is supplied by the battery 39.

When the interruption in service is greater than the delay time Δt set in the timing unit 36, the shutdown controller 21 is activated by the timer 36 to bring the motors to standstill in the manner previously described while maintaining the speed ratios of these motors.

Naturally, the timer 36 can be omitted, in which case immediately upon a power failure, the controller 21 will begin the shutdown sequence.

Naturally, when a timer 36 is provided, the capacity of the emergency supply battery 39 must be selected in accordance with the interval Δt so as to be certain that this battery will be able to bridge this period with a sufficient current supply and also the subsequent period for controlled shutdown of the motors.

Battery capacities larger than those required to supply up to several minutes of emergency power generally do not pay.

The operation of the apparatus illustrated in the event of a sudden power failure is thus as follows:

As soon as a current failure occurs, this is sensed at 34 which operates the detector 27 to deliver a pulse to the timing circuit 36 and to immediately actuate the relay 31 and deenergize the relay 33. The switch 30 is opened and the emergency service supply 39 takes over the energy supply to the electric motors.

Here two cases must be distinguished. In the first case the current failure is shorter than the time delay interval Δt set in the time delay circuit 36. The detector 27 then senses the restoration of power and reverses the states of the two relays 31, 33 and thereby restores lines power to the motors, resetting the timer 36 to its original state, opening the emergency supply switch 32 and closing the mains switch 30. The motors 14–16 continue to be energized in an uninterrupted manner.

In the second case, the power failure lasts longer than the delay time Δt. At the end of this delay time, the time delay unit 36 applies a signal to the shutdown controller 21 and via the latter to the program controller 20 so that there is a progressive reduction in the output frequencies of the frequency converters 25, 25' and 25'' in the predetermined ratio so that the motors 14–16 are driven at reduced speed but in the same ratio as at the original drive speed.

The restoration of power during this interval does not halt the sequence and, naturally, the operation can be reversed upon the restoration of power with the progressive buildup of speed of the motors in the fixed ratio.

The usual startup program of the machine can thus be instituted at the appropriate point in this case. Naturally at the same time the detector 27 will reverse the switches 30 and 32 to restore the lines power to the motors.

Naturally, instead of three electric motors with respective frequency converters for varying the output speeds of these motors, electric motors operating at constant speed can be provided and the outputs of these motors by appropriate transmissions or the like can be controlled, preferably electrically controlled variable speed transmissions.

In this case, the loads can be brought progressively to standstill while the motors continue to operate at their original speeds, the shutdown of current supply to these motors coming only when the respective load speeds have been reduced to standstill or to a level sufficiently low as to permit such shutdown. Naturally, the load speeds will be reduced in the fixed ratio required. Upon deenergization of the motors, the emergency supply 29 can also actuate respective brakes so that even the motors which might take a long time to reach standstill after deenergization can be brought rapidly to standstill to enable startup shortly after. Consequently, thread breakage is minimized in this system as well.

Other modifications which are possible within the context of the present invention include providing the second emergency power source 29 in common for a number of machines similar to the machine 10 which has been illustrated. This requires only that the capacity of the battery 39 and the capacity of the converter 40 be sufficient to accommodate the requirements of a plurality of machines. This can be the case also with the emergency battery 26 although it hardly pays to provide a common battery for control purposes for all of a number of machines since economically it has been found to be advantageous to provide independent emergency control batteries for each machine.

Figure 2:
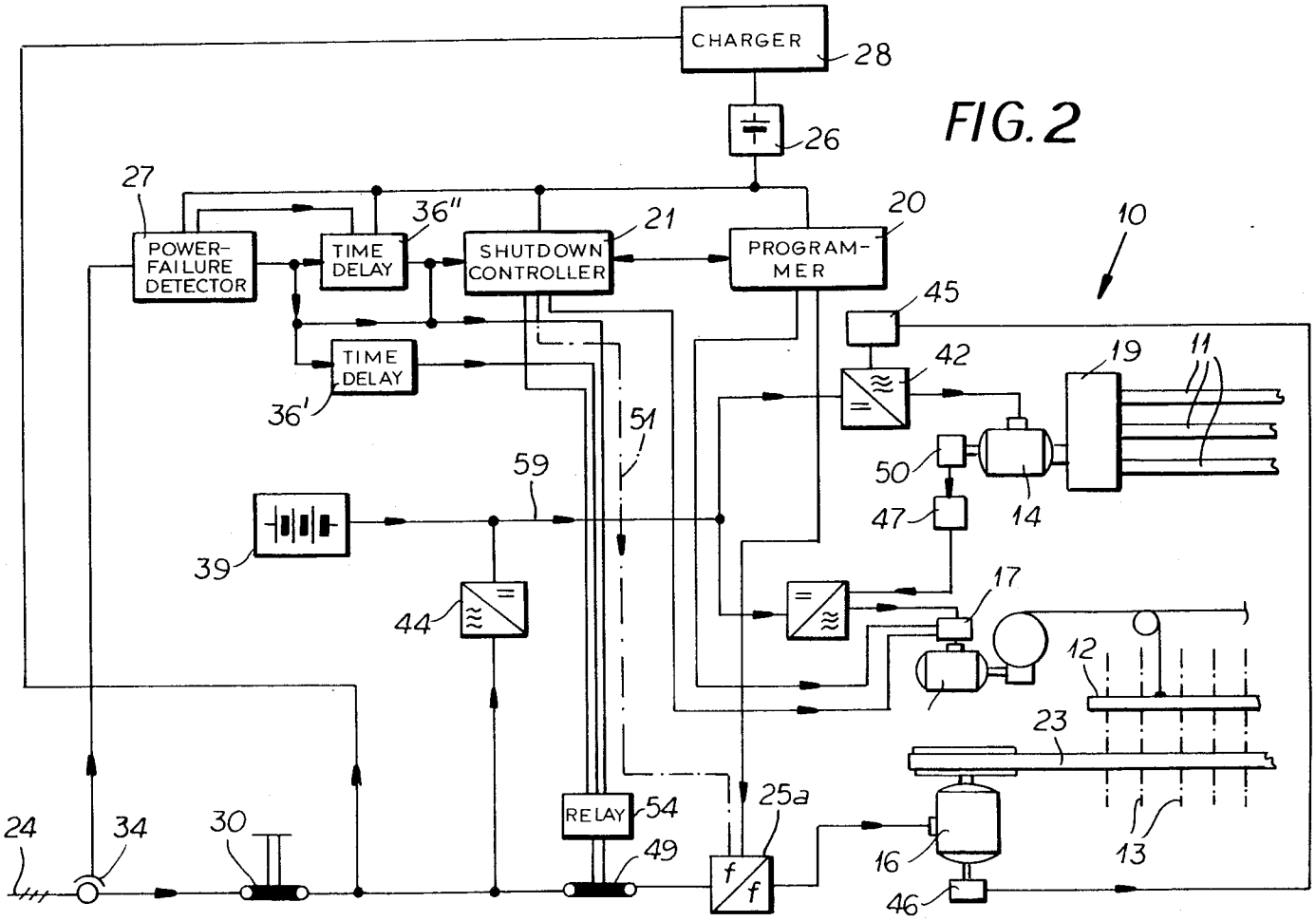
FIG. 2 is a similar diagram illustrating another embodiment of the circuitry of the invention.

The embodiment shown in FIG. 2 differs from that in FIG. 1 in several respects.

An important difference is that in the embodiment of FIG. 2 the drive motor 16 for the spindles 13 is not connected to the emergency power source 39 which is here constituted by batteries 26 and 39 supplying only direct current.

If all of the motors 14, 15 and 16 would be simultaneously deenergized, the motor 16 would continue to rotate for a much longer period than the motors 14 and 15, i.e. the motor 16 takes a substantially longer time to come to standstill.

For this reason, in the event of a sudden failure of the mains power, it is not necessary to supply the motor 16 with an emergency power source, this motor gradually coming to standstill over a relatively long period. However, the two other drive motors 14 and 15 must be subjected to controlled reduction in speed so as to prevent them from coming to standstill too quickly and thereby giving rise to yarn breakage. The two motors 14 and 15, therefore, are supplied by the emergency power source, in this case the battery 39. Consequently, at least two of the three motors are brought to controlled standstill while the third is permitted to reach standstill under normal diminution upon the deenergization of its motor.

The speed ratio among the motors is maintained during the speed reduction by a tachogenerator (tachometer) 46 connected to the motor 16 and whose output is supplied to a comparator 45 feeding the DC/AC converter 42 to adjust the frequency of the output of this converter to maintain the speed ratio of motor 14 with respect to the motor 16. The speed ratio between the motor 14 and the motor 15 is maintained by another tachogenerator (tachometer) 50 supplying a controller 47 which can also be a comparator, controlling the output frequency of the DC/AC converter 43 for the motor 15.

The comparators 45 and 47 act as speed setting elements and can have setpoint inputs representing the desired speed ratio or the actual speeds of the respective motors 14 and 15 so that the aforementioned fixed ratios are ensured.

In effect, therefore, the actual instantaneous speed of the motor 16 is applied through the speed setting element 45 to the motor 14, this speed setting element serving to maintain the speed ratio by reducing the speed of the motor 14 to match the speed reduction intrinsically effected in the motor 16 so that the preset ratio is maintained.

Similarly, the speed setting element 47 controls the ratio between the motors 14 and 15.

In this case, the motors 14 and 15 may be synchronous motors so that their speeds are controlled by the output frequencies of the respective DC/AC converters.

Between the converter 43 and motor 15, a reversing switch 17 is provided for the purposes described, i.e. to periodically reverse the motor 15 and thus operate the ring bank 11 in an up-and-down sequence under the control of the programmed controller 20 or the shutdown controller 21.

For example, the shutdown controller 21 can operate to shift the switch 17 into a position upon reduction of the speed of the machine to standstill so that the ring bank will always lower upon restarting of the machine. This is particularly advantageous because this helps reduce the tendency to yarn breakage at the restart of the machine.

The program controller 20 here also serves to control the output frequency of the converter 25*a* which supplies the motor 16. In the embodiment illustrated, the mains current supply 24 is provided with the sensor 34 connected to the failure detector 27 and in series with the mains switch 30. A relay 54 has a switch 49 connected between the mains and the frequency converter 25*a* to supply the motor 16 with electric power from the mains.

The motors 14 and 15, however, are not supplied directly from the mains. They are supplied via a rectifier 44 which serves to charge the battery 39 on the one hand and to supply direct current to the DC/AC converters 42 and 43.

The battery 26 is charged by the charger 28 in the manner previously described and supplies the control current to the power failure sensor 27, to the time delay circuit 36″, to the shutdown controller 21 and to the programmer 20.

The dot-dash line 51 showing an effective connection between the shutdown controller 21 and the frequency converter 25*a*, represents the control of the frequency converter 25*a* by the shutdown controller 21 for normal shutdown of the machine, i.e. shutdown in the event of some need other than a power failure.

Consequently, the output frequency of the converter 25*a* can be reduced in a programmed manner by the shutdown controller 21 in the event that power is maintained but shutdown is desired.

As long as there is current flowing in the supply network 24, the detector 27 does not sense a power failure. The direct current delivered to the converters 42 and 43 is transformed into three-phase alternating current to drive the respective motors and here the battery 39 serves exclusively as a buffer battery connected to the direct current bus 59.

In the embodiment of FIG. 2, moreover, two time delay elements 36′ and 36″ are provided, the functions of which will be clarified below.

In normal operation, the machine 10 is driven by line current, the switches 30 and 49 being closed. The motor 16 is driven at a speed determined by the frequency output of the frequency converter 25*a* and with three-phase alternating current.

The motors 14 and 15 are also driven with three-phase alternating current by the outputs from the respective DC/AC converters 42 and 43. The speed ratios of the motors 14, 15 and 16 are controlled by the speed setting elements 45 and 47 and the respective tachometers. The emergency battery 26 here serves to supply control current to the various control elements and is at constant charge via the charger 28. The emergency battery 39 is continuously connected to the bus 59 and likewise is continuously under full charge.

Normal shutdown of the machine 10 can be effected by the shutdown controller 21 in accordance with the predetermined program stored in the program controller 20.

In the event of sudden power failure in the line or mains 24, this is detected by the sensor 34 and transmitted to the detector 27 which outputs a pulse to both of the time delay circuits 36′ and 36″. The circuit 36″ functions in the manner described for the circuit 36 of FIG. 1 while the circuit 36′ delays for a brief period the opening of the relay 54 so that if the mains current is restored within this brief period, the circuit 36′ will be reenergized and, of course, the shutdown sequence terminated.

It will be understood that this brief period, usually in the millisecond range, is such that the speed of motor 16 is not substantially reduced by the cutoff of power.

Switch 49 is important because it avoids the possibility that the current will be reapplied to the motor 16 in a phase opposition manner so that the shocks which may result from a phase opposition reenergization can be avoided.

Switch 49 is opened and remains opened as long as the motor 16 requires deenergization, for example a period of 30 to 60 milliseconds which can be determined by the setting of the time delay unit 36′. After this brief period, the switch 49 is closed and it is assumed that the motor 16 will be reenergized and continue to drive the spindles.

The time delay circuit 36″, however, has a timing interval which may range from a fraction of a second to several minutes and is preferably between 3 and 5 seconds.

This time delay is intended to insure that once the machine has entered its shutdown program, a restoration of power will not immediately restore full drive power to all of the motors.

In the event of a sudden power failure of the line or mains 24, the shutdown of the machine should nevertheless extend over a full time interval of 7 to 10 seconds. This allows a normal use of a startup program and prevents a machine whose speed has been reduced progressively from suddenly jumping back to full speed with thread breakage and other detriment to the yarn. It also, in the manner previously described, ensures that the machine will not be brought to standstill unnecessarily, thereby avoiding interruptions in production. Restoration of power, therefore, resets the timer 36″ and prevents the shutdown program from operating when the interruption is less than $\Delta t$ in the manner described.

When, however, the power failure lasts longer than $\Delta t$, the time delay circuit 36″ provides a command at the end of this period to the shutdown controller 21 to begin the control shutdown operation. The shutdown controller 21 then activates the relay 54 to open the switch 49. It has been found to be advantageous to require the resetting of switch 49 by hand once it has been automatically opened. This ensures that restarting will not occur until all of the motors have been brought to standstill.

I claim:

1. In a spinning or twisting machine having at least two motors required to drive respective loads with a predetermined speed ratio and energized by a line-current source, the improvement which comprises:

an emergency power supply comprising at least one battery; and a circuit means operable upon an unforeseeable failure of said line-current source by said emergency power supply to effect a preprogrammed controlled shutdown of one of said motors while energizing at least the other of said motors by said emergency power supply, and maintaining said ratio at least until the speeds of said motors have fallen to a level at which substantial yarn breakage is precluded.

2. The improvement defined in claim 1 wherein:

a first of said motors slows to standstill upon deenergization more slowly than a second of said motors, said first of said motors upon such failure is permitted to slow to standstill without energization by said emergency power supply, and said second of said motors is energized by said emergency power supply under the control of said circuit means to slow to standstill while maintaining a fixed speed ratio with said first of said motors.

3. The improvement defined in claim 2 wherein said ratio is maintained during diminution in speed of both said motors by energization of said second of said motors by said emergency power supply at least until the motor speeds have been reduced to a level at which significant thread breakage cannot occur.

4. The improvement defined in claim 1 wherein at least one of said motors is an alternating current motor supplied by said line-current source through a DC/AC converter and a rectifier connected to said converter, said emergency power supply including a storage battery connectable to said converter.

5. The improvement defined in claim 4 wherein said battery is continuously connected to said rectifier and to said converter and forms a buffer battery for the motor connected to said converter.

6. The improvement defined in claim 2, further comprising a tachogenerator driven by said first of said motors and having an output frequency which is supplied to said second of said motors for controlling a frequency of energization thereof to maintain a given speed ratio between said motors.

7. The improvement defined in claim 6 wherein said first of said motors drive spindles of the spindle or twisting machine, said second of said motors drives drafting rollers of said machine, and said machine has a third motor driving a ring bank associated with said spindles, said second and third motors being operatively connected by another tachogenerator establishing a given speed ratio between said second and third motors.

8. The improvement defined in claim 2, further comprising:

a switch connected between said line-current source and said first of said motors, said line-current source being a three-phase alternating current source and said first of said motors being a three-phase motor, said switch disconnecting said first of said motors from said line-current source upon the detection of a failure thereof, and time-delay means connected to said switch for maintaining it open-circuited for a period of 30 to 90 milliseconds to prevent phase opposition reenergization of said first of said motors upon power restoration.

9. The improvement defined in claim 1 wherein said circuit means includes a time-delay circuit for mitigating said preprogrammed controlled shutdown only after a lapse of a period ranging from a fraction of a second to several minutes, whereby said shutdown is effected only for a power failure at least equal to said period and then continues substantially to completion.

10. The improvement defined in claim 1, further comprising a sensor responsive to said failure, and a shutdown controller connected to said sensor and at least to said second of said motors.

11. The improvement defined in claim 10 wherein said shutdown controller is connected to each of said motors for respectively reducing speeds thereof while maintaining a predetermined ratio of speeds therebetween.

12. The improvement defined in claim 11, further comprising a time-delay circuit between said sensor and said shutdown controller for triggering said shutdown controller only after a predetermined period of power failure whereby brief power failures do not interrupt operation of the machine.

13. The improvement defined in claim 11 wherein said shutdown controller is triggered immediately upon detection of said failure by said sensor.

14. The improvement defined in claim 11 wherein said emergency power supply includes a battery and a DC/AC converter, each of said motors having a frequency converter connectable to said DC/AC converter, said shutdown controller being connected to said frequency converter for controlling the speeds of said motors.

15. The improvement defined in claim 11 wherein said emergency power supply includes a battery and a DC/AC converter.

16. The improvement defined in claim 1 wherein said circuit means includes means for energizing at least one brake for at least one of said loads upon said failure.

* * * * *